US007589472B2

(12) United States Patent
Keith et al.

(10) Patent No.: US 7,589,472 B2
(45) Date of Patent: Sep. 15, 2009

(54) ELECTRONIC BALLAST WITH LAMP TYPE DETERMINATION

(75) Inventors: William L. Keith, Lake in the Hills, IL (US); George L Grouev, Arlington Heights, IL (US); Kent E. Crouse, Carpentersville, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 419 days.

(21) Appl. No.: 10/596,338

(22) PCT Filed: Dec. 9, 2004

(86) PCT No.: PCT/IB2004/052735

§ 371 (c)(1), (2), (4) Date: Jun. 9, 2006

(87) PCT Pub. No.: WO2005/060320

PCT Pub. Date: Jun. 30, 2005

(65) Prior Publication Data

US 2008/0218171 A1 Sep. 11, 2008

Related U.S. Application Data

(60) Provisional application No. 60/528,635, filed on Dec. 11, 2003.

(51) Int. Cl.
*H05B 41/14* (2006.01)

(52) U.S. Cl. ..... 315/94; 315/106; 315/307; 315/308; 315/DIG. 5

(58) Field of Classification Search ..... 315/94, 315/95, 97, 105–107, DIG. 5, 209 R, 291, 315/224, 307, 308
See application file for complete search history.

(56) References Cited

U.S. PATENT DOCUMENTS

| | | | | |
|---|---|---|---|---|
| 5,039,921 | A | 8/1991 | Kakitani | |
| 5,969,483 | A * | 10/1999 | Li et al. | 315/307 |
| 5,973,455 | A | 10/1999 | Mirskiy et al. | |
| 6,160,361 | A | 12/2000 | Giannopoulos et al. | |
| 6,323,605 | B1 | 11/2001 | Greenberg et al. | |
| 6,359,387 | B1 | 3/2002 | Giannopoulos et al. | |
| 6,525,479 | B1 | 2/2003 | Keggenhoff et al. | |
| 2002/0117976 | A1 * | 8/2002 | Ortmeyer | 315/291 |

FOREIGN PATENT DOCUMENTS

EP 1235468 A2 8/2002

* cited by examiner

*Primary Examiner*—Douglas W Owens
*Assistant Examiner*—Ephrem Alemu

(57) ABSTRACT

The electronic ballast with lamp type determination for an electronic ballast providing power to a lamp filament 208 includes a filament current sensing circuit 220 operably connected to the lamp filament 208 and generating a sensed filament current signal, and a microprocessor U2 receiving the sensed filament current signal and operably connected to control the power to the lamp filament 208. The microprocessor U2 is programmed to heat the lamp filament by applying the power at a first frequency, measure the filament characteristics, and determine lamp type from the measured filament characteristics. The microprocessor U2 can also be programmed to update operating parameters for the electronic ballast to suit the determined lamp type.

24 Claims, 4 Drawing Sheets

ELECTRONIC BALLAST WITH LAMP TYPE DETERMINATION

CROSS REFERENCE TO RELATED APPLICATION

This application is a national stage entry of PCT/IB04/52735, filed 9 Dec. 2004, which claims the priority benefit of U.S. provisional application Ser. No. 60/528,635, filed Dec. 12, 2003, which the entire subject matter is incorporated herein by reference.

This invention relates to electronic ballasts for gas discharge lamps, and more particularly, to an electronic ballast able to determine the installed lamp type.

Gas discharge lamps, such as fluorescent lamps, require a ballast to limit the current to the lamp. Electronic ballasts have become increasingly popular due to their many advantages. Electronic ballasts provide greater efficiency—as much as 15% to 20% over magnetic ballast systems. Electronic ballasts produce less heat, reducing building cooling loads, and operate more quietly, without "hum." In addition, electronic ballasts offer more design and control flexibility.

Electronic ballasts must operate with different supply voltages, different types of lamps, and different numbers of lamps. Supply voltages vary around the world and may vary in a single location depending on the power grid. Different types of lamps may have the same physical dimensions, so that different types of lamps can be used in a single fixture, yet be different electrically. An electronic ballast may operate with a single lamp, or two or more lamps. The electronic ballast must operate reliably and efficiently under the various conditions.

One particular challenge is to determine the type of lamp connected to the electronic ballast. Most ballasts do not determine lamp type and those that do use complex and expensive circuits to measure a particular lamp parameter, such as starting voltage or filament resistance. Such measurements are useful when the lamp is cool, but are inaccurate when the lamp is warm or has aged significantly. Starting voltage is an unreliable indicator of lamp type because the starting voltage varies greatly with lamp temperature, age, and manufacturer. Filament resistance is also unreliable because the filament resistance varies with filament temperature: the filament, which generates thermionic emission during lamp preheat and starting, may be hot or cold depending on whether the lamp operated recently. U.S. Pat. No. 5,039,921 to Kakitani discloses a discharge lamp lighting apparatus which identifies the type of the discharge lamp according to the starting voltage at ignition. U.S. Pat. No. 5,973,455 to Mirskiy et al. discloses an electronic ballast which indirectly detects filament resistance using a filament transformer, to provide an indication of lamp type.

It would be desirable to have an electronic ballast with lamp type determination that would overcome the above disadvantages.

One aspect of the present invention provides an electronic ballast affording lamp type determination regardless of lamp temperature.

Another aspect of the present invention provides an electronic ballast affording lamp type determination regardless of filament temperature.

Another aspect of the present invention provides an electronic ballast affording lamp type determination using a simple, inexpensive circuit.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

Various embodiment of the present invention are illustrated by the accompanying figures, wherein.

Figure 1:
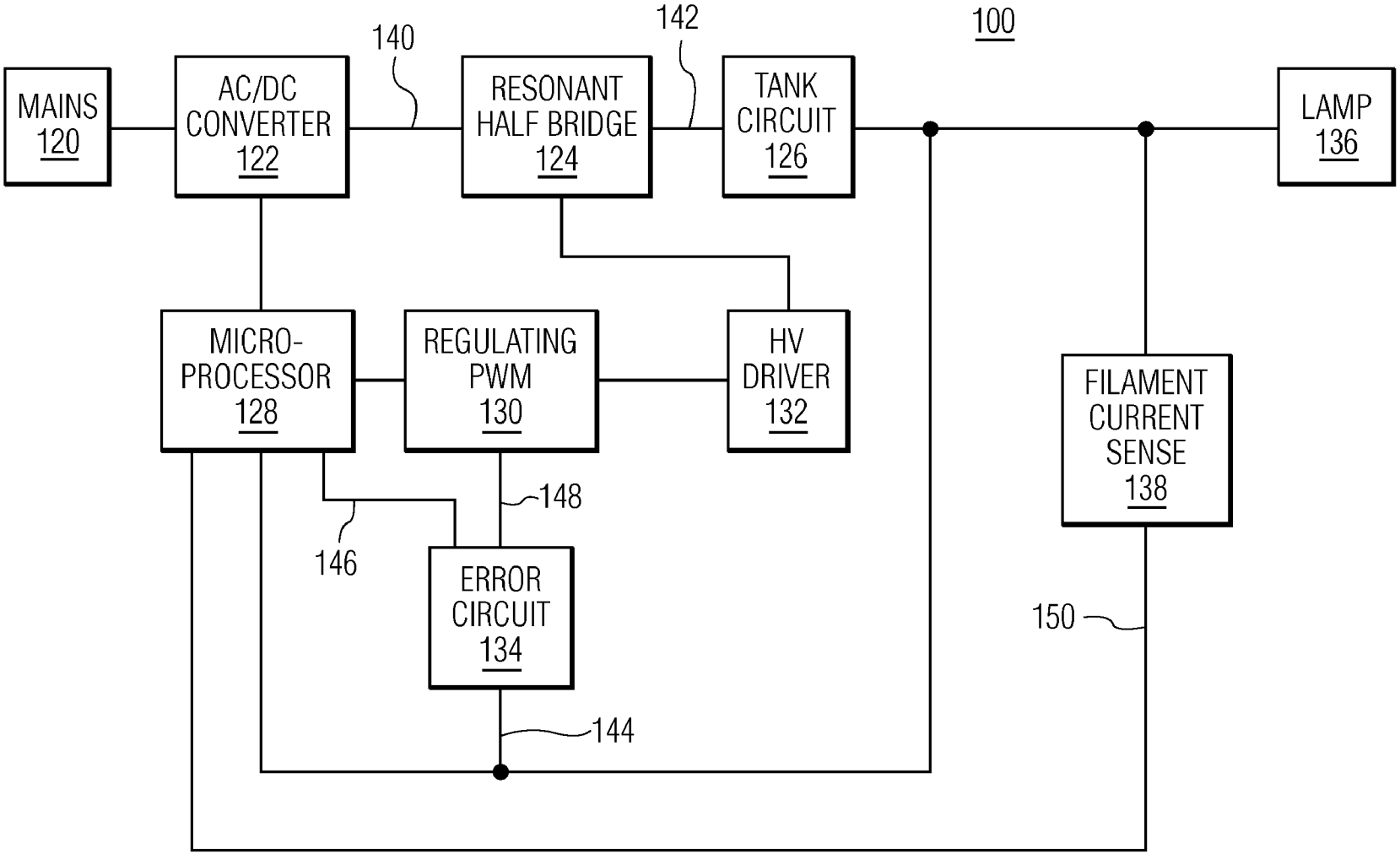
FIG. 1 is a block diagram of an electronic ballast with lamp type determination made in accordance with the present invention.

FIG. 1 is a block diagram of an electronic ballast with lamp type determination made in accordance with the present invention. The electronic ballast 100 consists of AC/DC converter 122, half bridge 124, resonant tank circuit 126, microprocessor 128, regulating pulse width modulator (PWM) 130, high voltage (HV) driver 132, error circuit 134, and a filament current sensing circuit 138. The AC/DC converter 122 receives the mains voltage 120 and the tank circuit 126 provides power to the lamp 136.

The mains voltage 120 is the AC line voltage supplied to the electronic ballast 100, such as 120V, 127V, 220V, 230V, or 277V. The mains voltage 120 is received at the AC/DC converter 122. The AC/DC converter 122 converts the AC mains voltage 120 to DC voltage 140, which is supplied to the half bridge 124. The AC/DC converter 122 typically includes an EMI filter and a rectifier (not shown). The AC/DC converter 122 can also include a boost circuit to increase the voltage of the DC voltage, such as from 180V to 470V. The half bridge 124 converts the DC voltage 140 to a high frequency AC voltage 142. The resonant tank circuit 126 supplies the AC voltage to the lamp 136. The high frequency AC voltage typically has a frequency in the range of 25 to 60 kHz.

The microprocessor 128 controls the operation of the electronic ballast 100. The microprocessor 128 stores and operates on programmed instructions, and senses parameters from throughout the electronic ballast 100 to determine the desired operating points. For example, the microprocessor 128 sets the AC voltage to different frequencies, depending on whether the lamp is in the preheat, strike, or run mode, or if no lamp is present. The microprocessor 128 can control the power conversion and voltage output from the AC/DC converter 122. The microprocessor 128 can also control the voltage and frequency of the AC voltage from the resonant tank circuit 126, by controlling the frequency and duty cycle of the half bridge 124 through the regulating PWM 130 and the HV driver 132. The error circuit 134 compares sensed lamp current 144 and desired lamp current 146 and provides a lamp current error signal 148 to the regulating PWM 130 for adjustment of lamp current through the regulating PWM 130 and the HV driver 132.

The filament current sensing circuit 138 detects lamp filament current during the lamp preheat sequence and provides a sensed filament current signal 150 to the microprocessor 128. The microprocessor 128 uses the filament current signal to determine the type of lamp installed and adjust lamp operating parameters for the particular lamp type.

Figure 2:
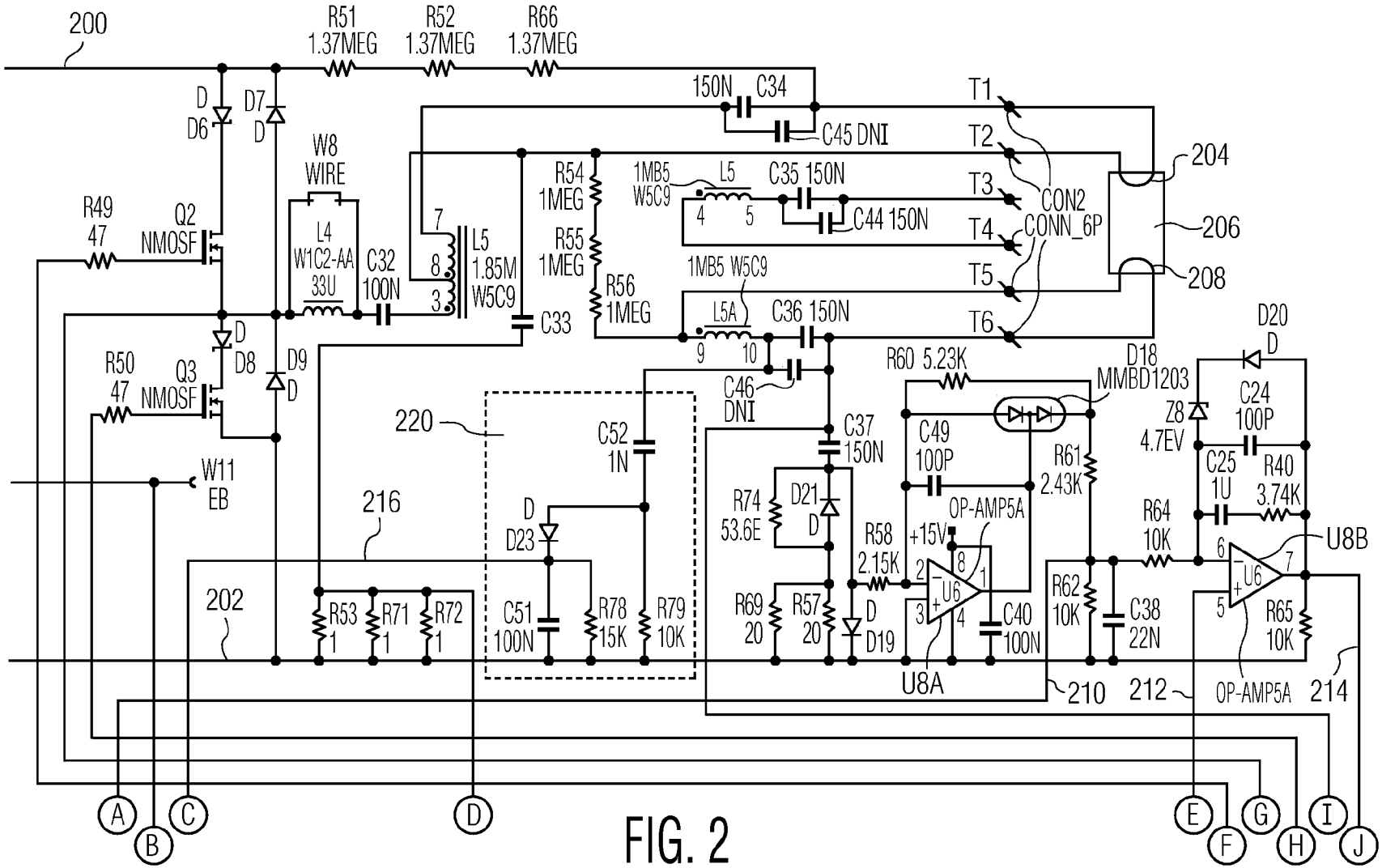
FIGS. 2 & 3 are schematic diagrams of an electronic ballast with lamp type determination made in accordance with the present invention.
Figure 3:
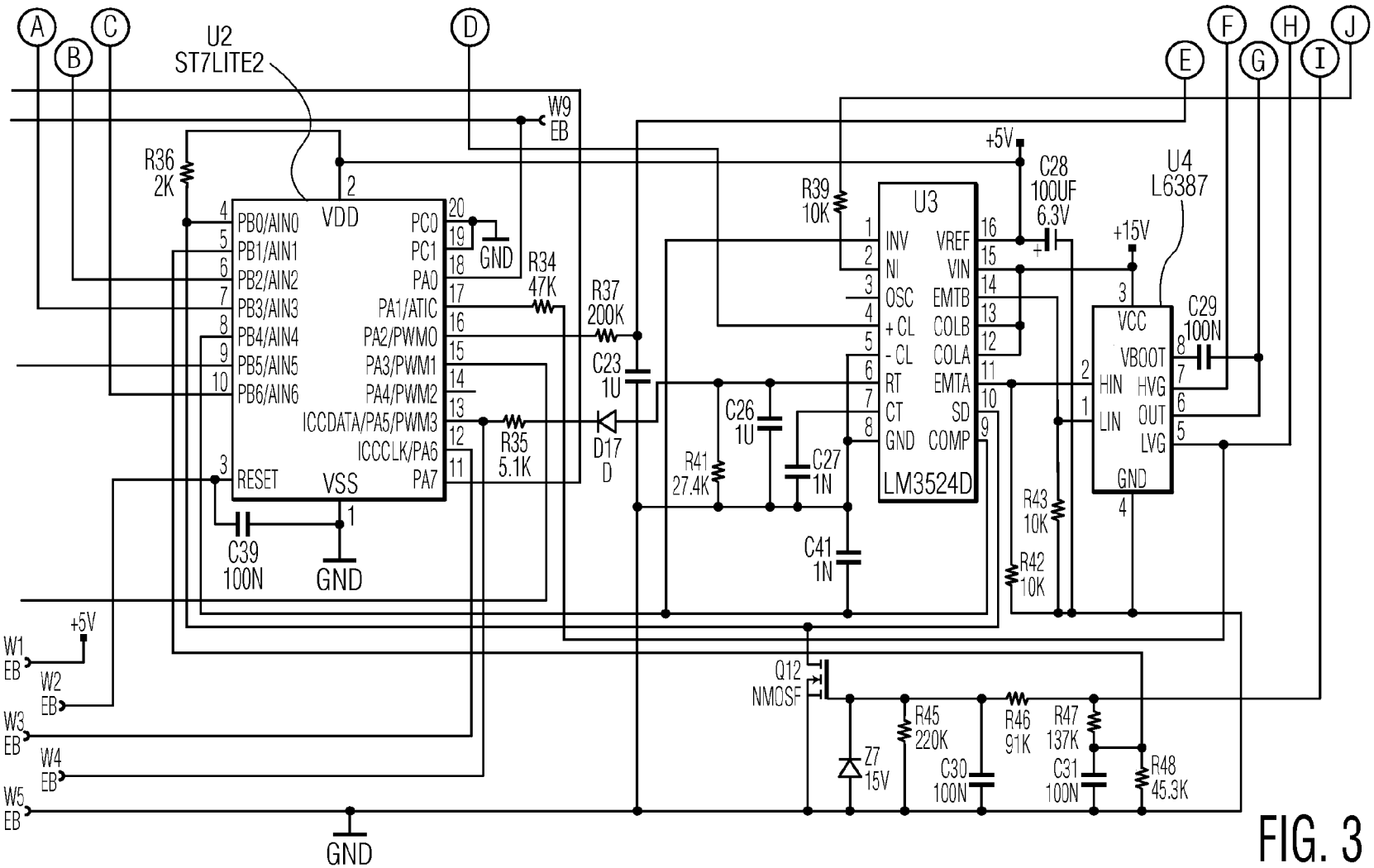

FIGS. 2 & 3 are schematic diagrams of an electronic ballast with lamp type determination made in accordance with the present invention.

Referring to FIG. 2, DC power is supplied to the resonant half bridge across high voltage rail 200 and common rail 202 by the AC/DC converter (not shown). Transistors Q2 and Q3 are connected in series between high voltage rail 200 and common rail 202 to form a half bridge circuit. The HV driver U4 of FIG. 3 drives the transistors Q2 and Q3 so that they conduct alternately. Inductor L5 and capacitor C33 form the resonant tank circuit and smooth the output at the junction between transistors Q2 and Q3 into a sinusoidal waveform. For use with a single lamp, the first filament 204 of the lamp 206 is connected across terminals T1 and T2 and the second filament 208 is connected across terminals T5 and T6. When two lamps are used with the electronic ballast, one filament from the first lamp is connected across terminals T1 and T2 and the one filament from the second lamp is connected across terminals T5 and T6. The other filaments, one from each lamp, are connected in series or parallel across terminals T3 and T4.

Referring to FIG. 3, the microprocessor U2 is operable to receive inputs from inside and outside the electronic ballast, and to control ballast operation. The microprocessor U2 determines the desired lamp operating frequency and sets the oscillator frequency of the regulating PWM U3, which drives the HV driver U4. The HV driver U4 drives the transistors Q2 and Q3. In one embodiment, the microprocessor U2 can be an ST7LITE2 available from STMicroelectronics, the regulating PWM U3 can be an LM3524D available from National Semiconductor, and the HV driver U4 can be an L6387 available from STMicroelectronics. Those skilled in the art will appreciate that the particular components other than the exemplary components described can be selected to achieve the desired result.

The error circuit senses lamp current at resistor R58 through capacitor C37. Current op amp U8A and high conductance ultra fast diode D18 compose a half wave rectifier with resistors R60 and R58 controlling gain. The sensed lamp current signal is provided to the microprocessor U2 on line 210 and to the error op amp U8B. The microprocessor U2 generates a desired lamp current signal based on inputs and the desired operating condition and returns the desired lamp current signal to the error op amp U8B along line 212. The error op amp U8B compares the sensed lamp current signal and the desired lamp current signal to generate a lamp current error signal on line 214, which provides the lamp current error signal to the regulating PWM U3. In response to the lamp current error signal, the regulating PWM U3 adjusts output pulse width, which adjusts the lamp current by the cycling of the transistors Q2 and Q3 with the HV driver U4. When the sensed lamp current signal equals the desired lamp current signal at the error op amp U8B, the lamp current error signal will zero out and the electronic ballast will be in a steady state mode.

The electronic ballast operates in preheat, strike, and run modes. The preheat mode provides a preheat sequence to the lamp filaments to induce thermionic emission and provide an electrical path through the lamp. The strike mode applies a high voltage to ignite the lamp. The run mode controls the current through the lamp after ignition.

Referring to FIG. 2, the filament current sensing circuit consists of capacitors C52 and C51, resistors R78 and R79, and diode D23. The filament current sensing circuit 220 is connected at the junction between resonant inductor L5A and DC blocking capacitors C36 and C46. The filament current sensing circuit 220 provides a sensed filament current signal on line 216 to an analog input of the microprocessor U2. The filament current sensing circuit 220 measures a voltage proportional to the current through the filament connected between terminals T5 and T6. Because there is always a filament connected across terminals T5 and T6, regardless of the number of lamps connected to the electronic ballast, the filament current sensing circuit 220 functions regardless of the number of lamps connected to the electronic ballast. Those skilled in the art will appreciate that additional filament current sensing circuits can be used to monitor the filaments connected across the other lamp terminals. For example, another filament current sensing circuit could be used to monitor the filament connected across terminals T1 and T2, because a filament will always be installed across those terminals in addition to the filament connected across terminals T5 and T6.

The capacitor C52 and resistor R79 are connected in series between the junction of resonant inductor L5A and capacitors C36 and C46, and the common rail 202. The diode D23 is connected in series with the low pass filter, capacitor C51 and resistor R78, between the junction of capacitor C52 and resistor R79 and the common rail 202. During the preheat sequence, the voltage across capacitor C51 is proportional to the current through the filament connected across terminals T5 and T6. Line 216 providing the sensed filament current signal to the microprocessor U2. The capacitor C52 and resistor R79 couples the signal from the filament to diode D23 which rectifies the signal, capacitor C51 and resistor R78 filter the signal, which is passed to the microprocessor U2 on line 216.

Figure 4:
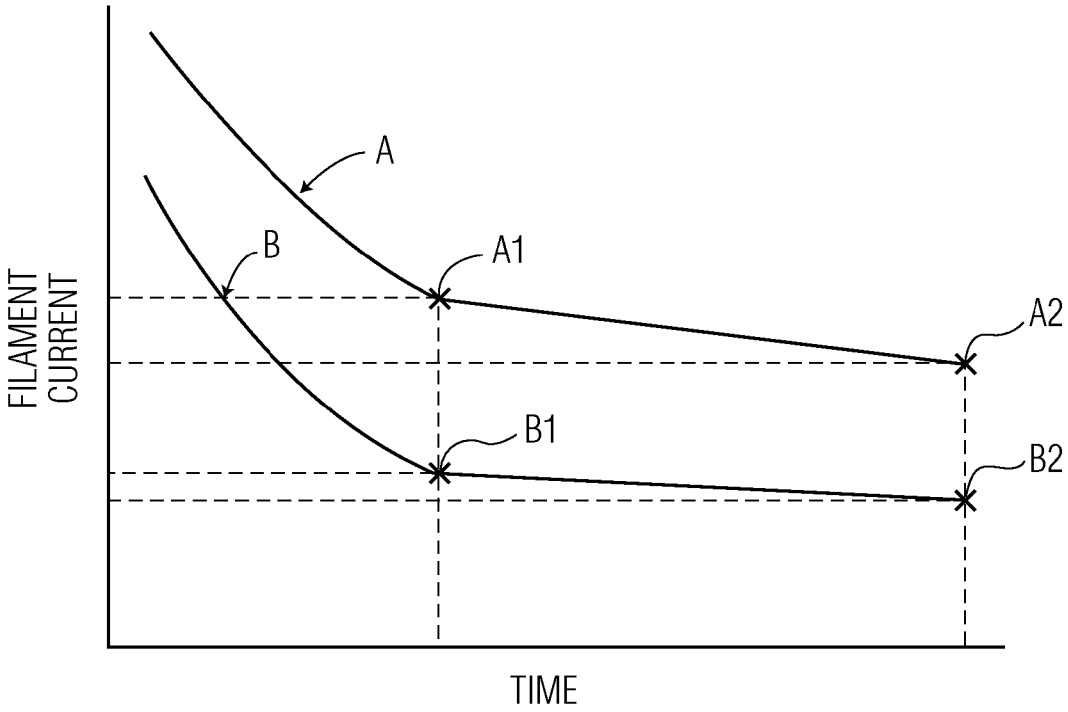
FIG. 4 is a graph showing filament current as a function of time for an electronic ballast with lamp type determination made in accordance with the present invention.

FIG. 4 is a graph showing filament current as a function of time for an electronic ballast with lamp type determination made in accordance with the present invention. The electronic ballast applies a preheat current to the filament so that the filaments emit electrons to facilitate igniting the lamp. The filament resistance increases as the filament heats up, so the filament current changes with filament temperature.

Profile A shows the filament current as a function of time for an exemplary 26 Watt compact fluorescent lamp (CFL), such as a Philips PL-C 26W/27/4P, and Profile B shows the filament current as a function of time for an exemplary 13 Watt CFL, such as a Philips PL-C 13W/41/4P. As shown, the filament current decays exponentially, rapidly initially, and then more slowly in a nearly linear fashion approaching a final filament current. The lamp type can be identified by classifying the profile which occurs during the preheat sequence. In this example, the profile can be characterized by the slope of the preheat sequence in the near-linear portion (A1-A2; B1-B2) and the final filament current (A2; B2).

The lamp type can also be identified by the relative magnitude or shape of the filament current curve. The higher wattage lamp of Profile A has a larger filament current than the lower wattage lamp of Profile B. The lower wattage lamp of Profile B has a steeper slope in the initial period up to point B1 than that of the higher wattage lamp of Profile A in the initial period up to point A1. The higher wattage lamp of Profile A has a steeper slope in the near-linear portion A1-A2 than that of the lower wattage lamp in the near-linear portion B1-B2. Those skilled in the art will appreciate that various features of the graph of filament current as a function of time can be used separately or in conjunction with each other to determine the lamp type. Furthermore, those skilled in the art will appreciate that the graph of filament current as a function of time provides an indication of the filament resistance as a function of temperature and that other indicators of filament resistance can be used instead of filament current.

Figure 5:
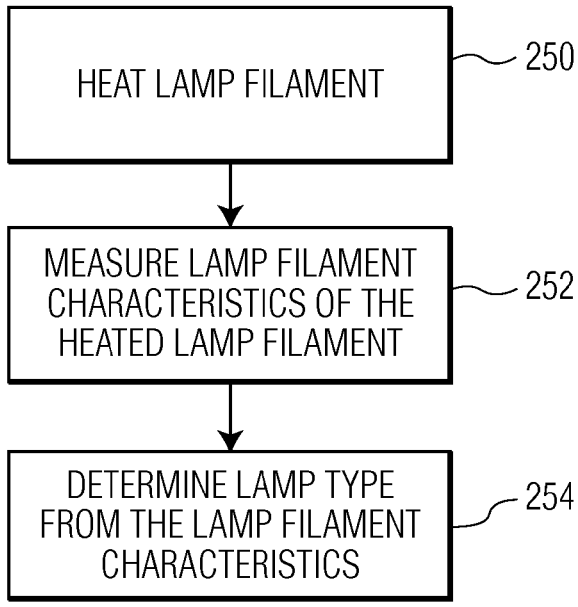
FIG. 5 is a flow chart of a method of lamp type determination for an electronic ballast in accordance with the present invention.

FIG. 5 is a flow chart of a method of lamp type determination for an electronic ballast in accordance with the present invention. The electronic ballast performs an initial heating of the lamp filament at 250, applying a voltage at a first frequency to the lamp filament. The initial heating provides a consistent starting condition for the lamp determination, regardless of the operating history of the lamp. If the lamp was operating recently, the filament may still be warm or hot. The initial voltage produces a current through the lamp filament which heats the lamp filament due to resistance. The initial heating makes the lamp determination more consistent regardless of the beginning filament temperature. In one embodiment, the initial heating is applied for 1000 ms. The electronic ballast then measures lamp filament characteristics of the heated lamp filament at 252 and the lamp type is determined from the lamp filament characteristics at 254. Once the lamp type is determined, the operating parameters in the microprocessor can be updated to reflect the particular lamp type in use. Those skilled in the art will appreciate that measuring filament characteristics of the heated filament 252 can be performed by a number of methods, such as measuring lamp filament current, measuring lamp filament resistance, and measuring lamp filament voltage.

In another embodiment, the electronic ballast measures the lamp filament characteristics by sensing the filament current at different times in the preheat sequence. In this embodiment, the initial heating is part of the preheat sequence. The same voltage and frequency are applied for the whole preheat sequence, which lasts for a predetermined time, such as 1000 ms.

The electronic ballast applies an initial voltage at a predetermined frequency, such as 50 kHz, across the lamp filament as an initial heating step. The electronic ballast then continues the preheat sequence at the same voltage and frequency. Halfway through the preheat sequence and after the initial heating, the microprocessor records a first lamp filament current as provided to the microprocessor on line 216 of FIG. 2. At the predetermined time at the end of the preheat sequence, the microprocessor records a second lamp filament current. The slope of the lamp filament current can be calculated from the first and second lamp filament currents. The second lamp filament current is the final lamp filament current. The lamp type is determined by comparing the measured lamp filament current slope and the second lamp filament current to a table stored in the microprocessor, which provides slopes and final filament currents indexed by lamp type.

Those skilled in the art will appreciate that lamp filament current data can be acquired at additional times to obtain a number of data points during the preheat sequence. The additional data points can be used to better define the lamp filament characteristics. In one data analysis approach, the data points can be fit to a curve, which is compared to a table of curves by lamp type stored in the microprocessor, or can be compared to the result of a mathematical formula.

In another embodiment, the electronic ballast measures the lamp filament characteristics by sensing the filament current at two different frequencies during the preheat sequence. The preheat sequence comprises applying voltage at a first frequency to the lamp filament for a first predetermined time, then applying voltage at a second frequency to the lamp filament for a second predetermined time. The initial heating occurs during the application of the first frequency. In one example, the first frequency is 50 kHz and the second frequency is 100 kHz, and the first predetermined time is 1000 ms and the second predetermined time is 10 ms.

The electronic ballast applies an initial voltage at a first frequency, such as 50 kHz, across the lamp filament as an initial heating step. The electronic ballast then continues the preheat sequence at the same voltage and frequency. After the initial heating and at the first predetermined time, the microprocessor records a first lamp filament current signal as provided to the microprocessor on line 216 of FIG. 2. The electronic ballast then applies a second voltage at a second frequency, such as 100 kHz, across the lamp filament. At the second predetermined time, the microprocessor records a second lamp filament current signal as provided to the microprocessor on line 216 of FIG. 2. The lamp type is determined by comparing the first and the second filament current signals to a table stored in the microprocessor, which provides filament currents indexed by lamp type.

In one example, the comparison can be made by an algorithm. Lamp types are classified by wattage as 13 W, 18 W, and 26 W. If the microprocessor detects a first lamp filament current signal greater than 3.00V and a second lamp filament current signal greater than 1.25V, the lamp type is determined to be 26 W. If the microprocessor detects a first lamp filament current signal less than 2.05V and a second lamp filament current signal less than 0.90V, the lamp type is determined to be 13 W. If the first and the second filament current signals are between the 13 W and 26 W values, the lamp type is determined to be 18 W.

Once the lamp type is determined, that information can be used to enhance operation of the electronic ballast and the lamp. The operating parameters in the microprocessor can be updated to reflect the particular lamp type in use. For example, the dimming curve c an be set to match the particular lamp type detected. Other operating parameters that can be set for the particular lamp type detected include maximum operating current, minimum operating current, operating frequency, and operating current as a function of frequency for a given dimming level.

The lamp type information can be used within the electronic ballast or used by systems external to the electronic ballast. The lamp type information can be stored in the microprocessor, such as storage in electrically erasable programmable read only memory (EEPROM) on board the microprocessor, or can be stored in memory external to the microprocessor. For electronic ballasts communicating with a central control and monitoring system, the lamp type information can be provided to the central control and monitoring system so that it can inventory and efficiently control lamps throughout the building. If the lamp type detected is not the correct type for the electronic ballast, the electronic ballast can provide visual or audible indication of the mismatch. For example, the microprocessor could make the lamp blink, so that so that maintenance personnel will learn of the mismatch and know to replace the lamp.

The stored lamp type can be used from one start to the next to avoid errors in determining lamp type. Filament characteristics can vary with age, manufacturing variations, and lamp use, and the variations can cause mistakes in determining the lamp type. To reduce such errors, the previously determined lamp type can be stored as a stored lamp type for comparison with the presently determined lamp type. If the presently determined lamp type appears to change from the stored lamp type, the lamp determination can be repeated to re-check the presently determined lamp type and confirm the change. In another embodiment, the stored lamp type can be a weighted average of the previously determined lamp types from the last few lamp starts.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A system for lamp type determination for an electronic ballast comprising:

means for heating a lamp filament by applying a voltage at a first frequency to the lamp filament for a predetermined time;

means for measuring a first filament current after the lamp filament has been heated and before the predetermined time;

means for measuring a second filament current at the predetermined time; and means for determining lamp type, including:

means for calculating a slope of a line connecting the first filament current and the second filament current as a function of time; and means for comparing the slope and the second filament current to slope and current values indexed by lamp type.

2. The system of claim 1, including means for updating lamp operating parameters to suit the determined lamp type.

3. The system of claim 1, including means for storing the determined lamp type.

4. The system of claim 1, including means for comparing the determined lamp type to a stored lamp type.

5. A system for lamp type determination for an electronic ballast comprising:

means for heating a lamp filament by applying a voltage at a first frequency to the lamp filament for a first predetermined time;

means for measuring a first filament current at the first predetermined time;

means for applying a second voltage at a second frequency to the lamp filament for a second predetermined time;

means for measuring a second filament current at the second predetermined time; and means for determining lamp type by comparing the first filament current and the second filament current to current values at different frequencies indexed by lamp type.

6. The system of claim 5, including means for providing indication if the determined lamp type is not correct for the electronic ballast.

7. An electronic ballast with lamp type determination, the electronic ballast providing power to a lamp filament, the electronic ballast comprising:

a filament current sensing circuit operably connected to the lamp filament and generating a sensed filament current signal; and a microprocessor receiving the sensed filament current signal and operably connected to control the power to the lamp filament;

wherein the microprocessor is programmed to:

heat the lamp filament by applying the power at a first frequency for a predetermined time;

measure a first filament current after the lamp filament has been heated and before the predetermined time;

measure a second filament current at the predetermined time; and determine a lamp type by:

calculating a slope of a line connecting the first filament current and the second filament current as a function of time; and comparing the slope and the second filament current to slope and current values indexed by lamp type.

8. The electronic ballast of claim 7 wherein the microprocessor 128 is programmed to update operating parameters for the electronic ballast to suit the determined lamp type.

9. The electronic ballast of claim 7 wherein the microprocessor 128 includes memory and is programmed to store the determined lamp type in the memory.

10. An electronic ballast comprising:

a power supply that is configured to supply a variable current to a filament of a lamp, one or more sensors that are configured to monitor the filament current of the lamp, a memory for storing one or more predefined time-dependent characteristics of each of a plurality of predefined lamp types, a processor that is configured to:

determine one or more time-dependent characteristics of the filament current based on at least a first filament current at a first time and a second filament current at a second time, determine a type of the lamp by comparing the one or more time-dependent characteristics of the lamp to one or more predefined time-dependent characteristics of each of a plurality of predefined lamp types, and control the power supply based on the type of the lamp.

11. The electronic ballast of claim 10, wherein the time-dependent characteristic of the lamp is a rate of change of the filament current.

12. The electronic ballast of claim of claim 10, wherein the memory is EEPROM disposed at the microprocessor.

13. The electronic ballast of claim of claim 10, wherein the memory is external to the microprocessor.

14. A method for lamp type determination for an electronic ballast comprising:

heating a lamp filament by applying a voltage at a first frequency to the lamp filament for a predetermined time;

measuring a first filament current after the lamp filament has been heated and before the predetermined time;

measuring a second filament current at the predetermined time; and determining a lamp type by:

calculating a slope of a line connecting the first filament current and the second filament current as a function of time; and comparing the slope and the second filament current to slope and current values indexed by lamp type.

15. The method of claim 14, including storing the determined lamp type.

16. The method of claim 14, wherein the measuring of the first filament current after the lamp filament has been heated and before the predetermined time comprises measuring the first filament current at about one half the predetermined time.

17. The method of claim 14, wherein the determining of the lamp type includes comparing the first filament current and the second filament current to current values at different frequencies indexed by lamp type.

18. The method of claim 14, including providing an indication if the determined lamp type is not correct for the electronic ballast.

19. The method of claim 14, wherein the measuring of the filament characteristics of the heated filament includes at least one of: measuring lamp filament current, measuring lamp filament resistance, and measuring lamp filament voltage.

20. The method of claim 14, comprising updating lamp operating parameters to suit the determined lamp type.

21. The method of claim 20, wherein the lamp operating parameters are selected from the group consisting of a dimming curve, a maximum operating current, a minimum operating current, an operating frequency, and an operating current as a function of frequency for a given dimming level.

22. The method of claim 14, including comparing the determined lamp type to a stored lamp type.

23. The method of claim 22 wherein the stored lamp type is selected from the group consisting of a preceding determined lamp type and a weighted average of previously determined lamp types.

24. The method of claim 22 further comprising re-checking the determined lamp type if the determined lamp type is different than the stored lamp type.

* * * * *